US010941655B2

(12) United States Patent
Gisolf et al.

(10) Patent No.: US 10,941,655 B2
(45) Date of Patent: Mar. 9, 2021

(54) DOWNHOLE FILTRATE CONTAMINATION MONITORING WITH CORRECTED RESISTIVITY OR CONDUCTIVITY

(71) Applicant: Schlumberger Technology Corporation, Sugar Land, TX (US)

(72) Inventors: Adriaan Gisolf, Houston, TX (US); Lei Jiang, Beijing (CN); Anthony Robert Holmes Goodwin, Sugar Land, TX (US); Youxiang Zuo, Burnaby (CA)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 478 days.

(21) Appl. No.: 14/846,591

(22) Filed: Sep. 4, 2015

(65) Prior Publication Data

US 2017/0067338 A1 Mar. 9, 2017

(51) Int. Cl.

| | |
|---|---|
| ***E21B 49/10*** | (2006.01) |
| ***E21B 49/08*** | (2006.01) |
| ***E21B 49/00*** | (2006.01) |
| ***E21B 47/00*** | (2012.01) |

(52) U.S. Cl.

CPC ..... *E21B 49/081* (2013.01); *E21B 49/10* (2013.01); *E21B 49/0875* (2020.05)

(58) Field of Classification Search

CPC ..... E21B 49/081
USPC ..... 702/7
See application file for complete search history.

(56) References Cited

U.S. PATENT DOCUMENTS

| | | | | |
|---|---|---|---|---|
| 6,272,434 | B1 | 8/2001 | Wisler et al. | |
| 6,729,400 | B2 | 5/2004 | Mullins et al. | |
| 7,028,773 | B2 | 4/2006 | Fujisawa et al. | |
| 2003/0145988 | A1 | 8/2003 | Mullins et al. | |
| 2004/0000400 | A1 | 1/2004 | Fujisawa et al. | |
| 2005/0182566 | A1 | 8/2005 | DiFoggio | |
| 2007/0238180 | A1 | 10/2007 | DiFoggio et al. | |
| 2013/0311099 | A1 * | 11/2013 | Eyuboglu | E21B 49/081 702/11 |

(Continued)

FOREIGN PATENT DOCUMENTS

WO WO2012094007 A2 7/2012

OTHER PUBLICATIONS

Zuo et al., A New Method for OBM Decontamination i Downhole Fluid Analysis, Mar. 26-28, 2013, International Petroluem Technology Conference, Beijing, China, pp. 1-8.*

(Continued)

*Primary Examiner* — Omar F Mojaddedi
(74) *Attorney, Agent, or Firm* — Trevor G. Grove

(57) ABSTRACT

A method includes operating a downhole acquisition tool in a wellbore in a geological formation. The wellbore or the geological formation, or both, contains a fluid that includes a native reservoir fluid of the geological formation and a contaminant. The method also includes receiving a portion of the fluid into the downhole acquisition tool, obtaining a measured resistivity, a measured conductivity, or both of the portion of the fluid using the downhole acquisition tool, and using a processor of the downhole acquisition tool to obtain a temperature-corrected resistivity, a temperature-corrected conductivity, or both based on a downhole temperature of the portion of the fluid and the measured resistivity, the measured conductivity, or both.

20 Claims, 6 Drawing Sheets

(56) References Cited

U.S. PATENT DOCUMENTS

| | | | | |
|---|---|---|---|---|
| 2014/0062487 | A1* | 3/2014 | Bloemenkamp ..... | G01V 3/24 324/324 |
| 2014/0180591 | A1 | 6/2014 | Hsu et al. | |
| 2015/0135814 | A1 | 5/2015 | Zuo et al. | |
| 2015/0308264 | A1 | 10/2015 | Zuo et al. | |
| 2016/0281501 | A1* | 9/2016 | Bin Muhammad Moizuddin ..... | E21B 49/10 |

OTHER PUBLICATIONS

Villareal et al., Sampling While Drilling: An Emerging Technology, SPE 159503, San Antonio, Texas, USA, Oct. 8-10, 2012 (24 pages).

Wang, P.; Anderko, A.; Young, R. D. A Speciation-based model for mixed-solvent electrolyte systems, Fluid Phase Eq. 2002, 203, pp. 141-176.

Wang, P.; Anderko, A.; Young, R. D. Modeling Electrical Conductivity in Concentrated and Mixed-Solvent Electrolyte Solutions, Ind. Eng. Chem. Res. 2004, 43, 8083-8092.

Archer, D. G., Carter, R. W., Thermodynamic Properties of the NaCl + H2O System. 4. Heat Capacities of H2O and NaCl(aq) in Cold-Stable and Supercooled States, J. Phys. Chem. B. 2000, 104, 8563-8584.

International Search Report issued in the related PCT Application, dated Nov. 18, 2016 (10 pages).

Villareal, et al., "Characterization of Sampling-While-Drilling Operations", SPE 128249, IADC/SPE Drilling Conference and Exhibition, New Orleans, Louisiana, USA, Feb. 2-4, 2010 (16 pages).

Zuo, et al., "A New Method for OBM Decontamination in Downhole Fluid Analysis", IPTC 16524—6th International Petroleum Technology Conference, Beijing, China, Mar. 26-28, 2013 (8 pages).

McCain, "The Properties of Petroleum Fluids, 2nd Edition", PennWell Publishing, 1990, pp. 444-450.

International Search Report and Written Opinion issued in PCT/US2014/066434 dated Feb. 24, 2015, (11 pages).

Al-Musharfi et al., The challenge of water sampling with a wireline formation tester in a transition zone, May 25-28, 2008, SPWLA 49th Annual Logging Symposium, pp. 1-14.

* cited by examiner

DOWNHOLE FILTRATE CONTAMINATION MONITORING WITH CORRECTED RESISTIVITY OR CONDUCTIVITY

BACKGROUND

This disclosure relates to determining water-based mud contamination of native formation fluids downhole.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

Reservoir fluid analysis may be used in a wellbore in a geological formation to locate hydrocarbon-producing regions in the geological formation, as well as to manage production of the hydrocarbons in these regions. A downhole acquisition tool may carry out reservoir fluid analysis by drawing in formation fluid and testing the formation fluid downhole or collecting a sample of the formation fluid to bring to the surface. Although native reservoir fluid (e.g., oil, gas, or water) from a hydrocarbon reservoir in the geological formation may be the fluid of interest for reservoir fluid analysis, fluids other than the native reservoir fluid may contaminate the native reservoir fluid. As such, the formation fluid obtained by the downhole acquisition tool may contain extraneous materials other than pure native reservoir fluid. Drilling muds, for example, may be used in drilling operations and may mix with the native reservoir fluid. The formation fluid drawn from the wellbore thus may be a mixture of native reservoir fluid and drilling mud filtrate. Of certain concern are drilling fluids known as water-based mud that may be miscible with water in the geological formation. The miscibility of the water-based mud and the formation water may cause difficulties in evaluation of the formation water for assessing the hydrocarbon regions, in particular the region's economic value.

SUMMARY

This summary is provided to introduce a selection of concepts that are further described below in the detailed description. This summary is not intended to identify key or essential features of the subject matter described herein, nor is it intended to be used as an aid in limiting the scope of the subject matter described herein. Indeed, this disclosure may encompass a variety of aspects that may not be set forth below.

In one example, a method includes operating a downhole acquisition tool in a wellbore in a geological formation. The wellbore or the geological formation, or both, contains a fluid that includes a native reservoir fluid of the geological formation and a contaminant. The method also includes receiving a portion of the fluid into the downhole acquisition tool, obtaining a measured resistivity, a measured conductivity, or both of the portion of the fluid using the downhole acquisition tool, and using a processor of the downhole acquisition tool to obtain a temperature-corrected resistivity, a temperature-corrected conductivity, or both based on a downhole temperature of the portion of the fluid and the measured resistivity, the measured conductivity, or both.

In another example, a downhole fluid testing system includes a downhole acquisition tool housing that may be moved into a wellbore in a geological formation. The wellbore or the geological formation, or both, contains fluid that includes a native reservoir fluid of the geological formation and a contaminant, and the downhole acquisition tool includes a sensor disposed in the downhole acquisition tool housing that may analyze portions of the fluid and obtain sets of properties of the portions of the fluid. Each set of properties includes a measured resistivity, a measured conductivity, or both of the portion of the fluid. The system also includes a data processing system that may estimate a volume fraction of the contaminant in at least one of the portions of the fluid based at least in part on the measured resistivity or the measured conductivity of the at least one portion of the fluid. The data processing system includes one or more non-transitory, machine-readable media including instructions that may correct the measured resistivity, the measured conductivity, or both for downhole temperature variations to obtain a temperature-corrected resistivity, a temperature-corrected conductivity, or both.

In another example, one or more tangible, non-transitory, machine-readable media includes instructions to receive a fluid parameter of a portion of fluid as analyzed by a downhole acquisition tool in a wellbore in a geological formation. The wellbore or the geological formation, or both, contains the fluid, the fluid includes a mixture of native reservoir fluid of the geological formation and a contaminant, and the fluid parameter includes a measured resistivity, a measured conductivity, or both of the portion of the fluid. The one or more tangible, non-transitory, machine-readable media also includes instructions to estimate a volume fraction of the contaminant in the portion of the fluid based at least in part on a temperature-corrected resistivity, a temperature-corrected conductivity, or both of the portion of the fluid. The temperature-corrected resistivity and the temperature-corrected conductivity are corrected for downhole temperature variations of the fluid before estimating the volume fraction of the contaminant.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
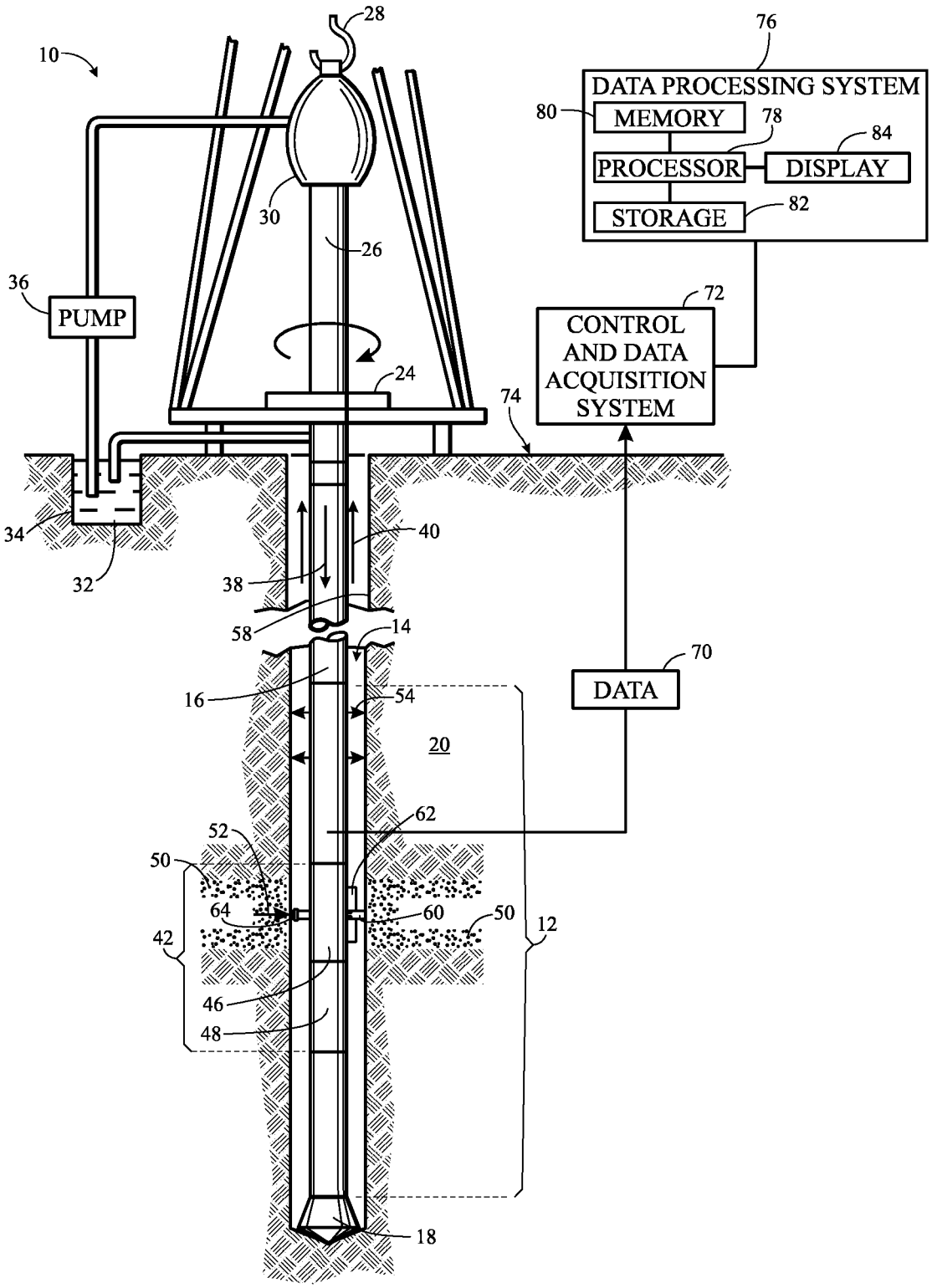
FIG. 1 is a schematic diagram of a wellsite system that may employ downhole fluid analysis methods for determining water-based mud contamination in a formation fluid, in accordance with an embodiment.

One or more specific embodiments of the present disclosure will be described below. These described embodiments are examples of the presently disclosed techniques. Additionally, in an effort to provide a concise description of these embodiments, features of an actual implementation may not be described in the specification. It should be appreciated that in the development of any such actual implementation, as in any engineering or design project, numerous implementation-specific decisions may be made to achieve the developers' specific goals, such as compliance with system-related and business-related constraints, which may vary from one implementation to another. Moreover, it should be appreciated that such a development effort might be complex and time consuming, but would still be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Acquisition and analysis of representative formation fluid samples downhole in delayed or real time may be useful for determining the economic value of hydrocarbon reserves and oil field development. However, formation fluid samples may be contaminated with drilling fluids that penetrate the geological formation during and/or after drilling operations. As such, it may be difficult to assess a composition of the geological formation fluid (also referred to as "native formation fluid") and determine the economic value of the hydrocarbon reserves. For example, native formation fluids, such as gas, oil, and formation water, may be miscible with the drilling fluid (e.g., oil-based mud filtrate or water-based mud filtrate), thereby affecting sample quality and analysis. Downhole acquisition tools may acquire formation fluid (e.g., drilling mud contaminated formation fluid or uncontaminated/native formation fluid) and test the formation fluid to determine and/or estimate an amount of mud filtrate in the formation fluid. Based on the amount of mud filtrate in the formation fluid, an operator of the downhole acquisition tool may determine when the formation fluid sample is representative of uncontaminated native reservoir fluid. In this way, the fluid properties and composition of the native reservoir fluid may be analyzed to determine the economic value of the hydrocarbon reserve. In addition, monitoring mud contamination downhole, e.g., in real time, avoids delays associated with fluid analysis at surface or at a remote location (e.g., offsite laboratory), thereby decreasing the overall operational costs of wellbore drilling operations.

Evaluation of formation water may be of particular interest to operators. Formation water analysis may play a role in dynamic modeling of hydrocarbon reservoirs, quantification of reserves, and determining completion costs for reservoirs. Additionally, formation water analysis may provide information about reservoir connectivity and characterization of transitions zones (e.g., in carbonates). Therefore, formation water analysis may be used to understand and determine the economic value of reservoirs of interests. However, during drilling operations, drilling muds may penetrate the formation, thereby contaminating native formation water. In the case of water-based drilling muds, water-based drilling mud filtrate that penetrates the formation is generally miscible with the native formation water. The native formation water, the water-based mud filtrate, and the contaminated formation water have different fluid properties. Therefore, formation water analysis may rely on fluid properties such as resistivity and conductivity to determine an amount of water-based filtrate contamination in the formation water.

Downhole acquisition tools such as wellbore formation testers (WFT) may perform downhole fluid analysis to acquire, monitor, and analyze the formation fluid (e.g., contaminated and uncontaminated formation fluids) downhole. In some cases, this may be carried out in real time (e.g., the fluid is analyzed while sampling). Downhole fluid analysis allows the formation fluid to be analyzed under wellbore conditions (e.g., pressure and temperature), thereby providing a better indication of the volume and composition of the formation fluid compared to surface analysis techniques, which may be unable to maintain the formation fluid at wellbore pressures and temperatures.

The downhole acquisition tools include multiple sensors that measure fluid properties, such as gas-to-oil ratio (GOR); mass density; optical density (OD) at multiple optical channels; compositions of carbon dioxide ($CO_2$), $C_1$, $C_2$, $C_3$, $C_4$, $C_5$, and/or $C_{6+}$; formation volume factor; viscosity; resistivity; fluorescence; temperature; and/or others. In some cases, these properties may be measured substantially in real time. The measured fluid properties may be used to determine and/or estimate (e.g., predict) an amount of the water-based mud filtrate contamination in the formation fluid (e.g., formation water). For example, differences in the fluid properties between the native reservoir fluid (e.g., uncontaminated reservoir fluid) and pure water-based mud filtrate may be used to monitor and quantify water-based mud filtrate contamination of the formation fluid. However, the fluid properties of the native formation fluid and the pure water-based mud filtrate may be difficult to measure directly. As discussed above, the water-based mud penetrates the geological formation during drilling, thereby mixing with the native formation water before drilling fluid analysis. Additionally, the water-based mud used during drilling operations may be generally reused between wells. Accordingly, since these materials may be mixed together to some degree, the respective separate fluid properties of the native formation fluid and the pure water-based mud may be generally unavailable.

One technique for monitoring water-based mud filtrate contamination in formation water is to use resistivity data from formation water samples. For example, resistivity data may be used to calculate a conductivity of the formation water sample. The conductivity may be used to quantify water-based mud (WBM) filtrate contamination in the formation water sample using a combination of various techniques such as power law fitting and extrapolation, cross plotting fluid properties, and mixing rules. These techniques generally assume that a temperature of the formation water samples is constant, and any changes in density and conductivity of the formation water sample are based solely on an amount of WBM filtrate contamination. However, conductivity is temperature dependent. Therefore, changes in the conductivity of the formation water sample may also be due to changes in temperature of the formation water sample. That is, both water-based mud filtrate contamination and a temperature of the formation water sample may cause changes in the conductivity of the formation water sample. Therefore, water-based mud filtrate contamination techniques that do not consider the temperature of the formation water downhole may result in inaccurate quantification of water-based mud filtrate in the formation water sample.

The systems and methods of this disclosure may increase the accuracy of water-based mud filtrate contamination quantification in formation fluids, which may be advantageous for operators to determine whether to proceed with or abandon hydrocarbon recovery for a given wellbore. Accordingly, present embodiments include techniques that correct for temperature variations in the formation water sample to improve quantification and estimation accuracy of water-based mud filtrate contamination. In particular, the disclosed embodiments use a relationship between resistivity and temperature of the contaminated formation fluid, the native formation fluid, and pure water-based mud filtrate to accurately quantify an amount of water-based mud contamination in downhole fluid analysis. In certain embodiments, the relationship between the resistivity and the temperature may be used to determine a conductivity of the formation fluid, which may also be used to accurately quantify the amount of water-based mud contamination in downhole fluid analysis.

Figure 2:
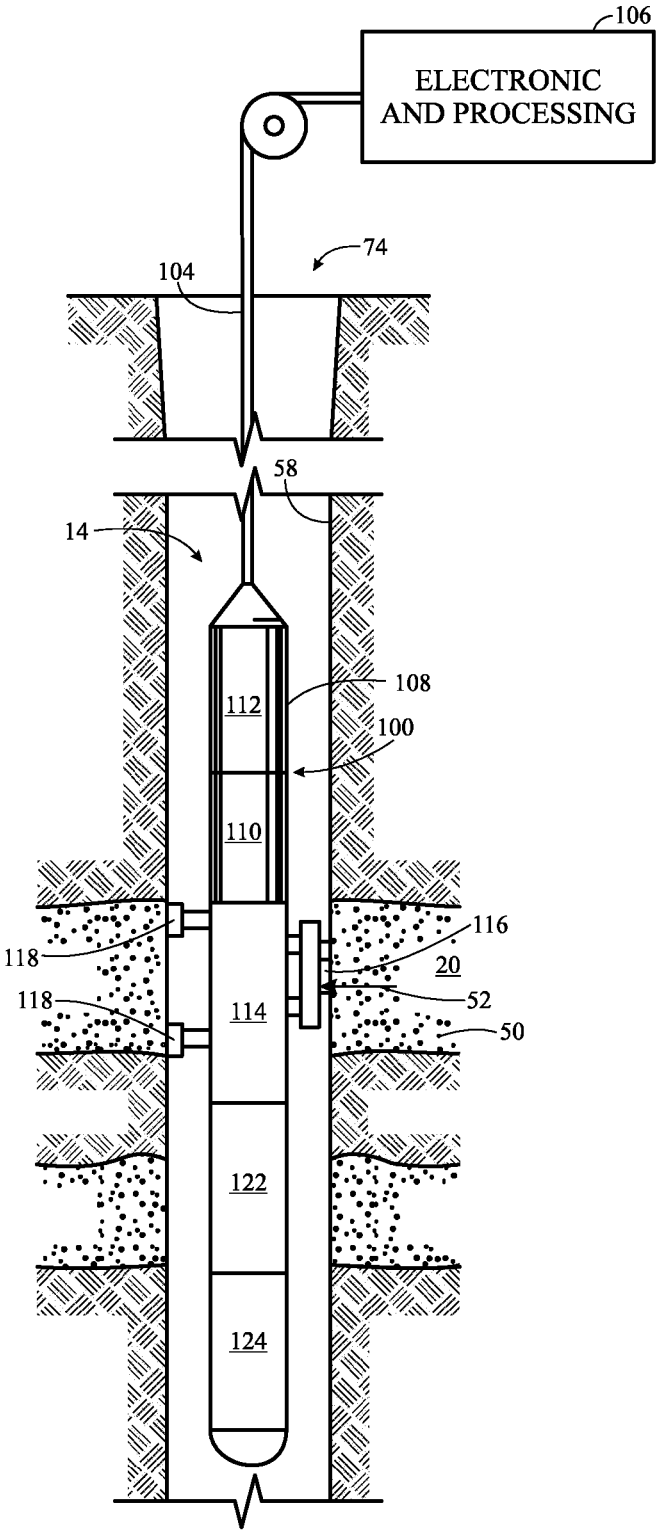
FIG. 2 is a schematic diagram of another embodiment of a wellsite system that may employ downhole fluid analysis methods for determining water-based mud contamination in a formation fluid, in accordance with an embodiment.

FIGS. 1 and 2 depict examples of wellsite systems that may employ the fluid analysis systems and techniques described herein. FIG. 1 depicts a rig 10 with a downhole tool 12 suspended therefrom and into a wellbore 14 via a drill string 16. The downhole tool 12 has a drill bit 18 at its lower end thereof that is used to advance the downhole tool 12 into a geological formation 20 and form the wellbore 14. The drill string 16 is rotated by a rotary table 24, energized by means not shown, which engages a kelly 26 at the upper end of the drill string 16. The drill string 16 is suspended from a hook 28, attached to a traveling block (also not shown), through the kelly 26 and a rotary swivel 30 that permits rotation of the drill string 16 relative to the hook 28. The rig 10 is depicted as a land-based platform and derrick assembly used to form the wellbore 14 by rotary drilling. However, in other embodiments, the rig 10 may be an offshore platform.

Drilling fluid or mud 32 (e.g., water-base mud (WBM)) is stored in a pit 34 formed at the well site. A pump 36 delivers the drilling fluid 32 to the interior of the drill string 16 via a port in the swivel 30, inducing the drilling mud 32 to flow downwardly through the drill string 16 as indicated by a directional arrow 38. The drilling fluid exits the drill string 16 via ports in the drill bit 18, and then circulates upwardly through the region between the outside of the drill string 16 and the wall of the wellbore 14, called the annulus, as indicated by directional arrows 40. The drilling mud 32 lubricates the drill bit 18 and carries formation cuttings up to the surface as it is returned to the pit 34 for recirculation.

The downhole acquisition tool 12, sometimes referred to as a bottom hole assembly ("BHA"), may be positioned near the drill bit 18 and includes various components with capabilities, such as measuring, processing, and storing information, as well as communicating with the surface. A telemetry device (not shown) also may be provided for communicating with a surface unit (not shown). As should be noted, the downhole tool 12 may be conveyed on wired drill pipe, a combination of wired drill pipe and wireline, or other suitable types of conveyance.

The downhole acquisition tool 12 further includes a sampling system 42 including a fluid communication module 46 and a sampling module 48. The modules may be housed in a drill collar for performing various formation evaluation functions, such as pressure testing and fluid sampling, among others. As shown in FIG. 1, the fluid communication module 46 is positioned adjacent the sampling module 48; however the position of the fluid communication module 46, as well as other modules, may vary in other embodiments. Additional devices, such as pumps, gauges, sensors, monitors or other devices usable in downhole sampling and/or testing also may be provided. The additional devices may be incorporated into modules 46, 48 or disposed within separate modules included within the sampling system 42.

In certain embodiments, the downhole acquisition tool 12 may evaluate fluid properties of the drilling mud 32, native formation fluid 50, and/or a contaminated formation fluid, as illustrated by arrow 52. Accordingly, the sampling system 42 may include sensors that may measure fluid properties such as gas-to-oil ratio (GOR); mass density; optical density (OD); composition of carbon dioxide ($CO_2$), $C_1$, $C_2$, $C_3$, $C_4$, $C_5$, and/or $C_{6+}$; formation volume factor; viscosity; resistivity; conductivity, fluorescence; and/or combinations of these properties of the drilling mud 32, native formation fluid 50 (e.g., native formation water), and/or formation fluid 52. As should be noted, the formation fluid 52 may be the drilling mud 32, the native formation fluid 50, or a mixture of the drilling mud 32 and the native formation fluid 50. For example, during drilling, the drilling mud 32 may penetrate wellbore wall 58, as illustrated by arrow 54, thereby contaminating the native formation fluid 50. Therefore, as discussed in further detail below, the sampling system 42 may be used to monitor water-based mud filtrate contamination to determine an amount of the drilling mud filtrate 54 in the formation fluid 52 (e.g., the drilling mud 32, the native formation fluid 50, or a combination thereof).

The fluid communication module 46 includes a probe 60, which may be positioned in a stabilizer blade or rib 62. The probe 60 includes one or more inlets for receiving the formation fluid 52 and one or more flow lines (not shown) extending into the downhole tool 12 for passing fluids (e.g., the formation fluid 52) through the tool. In certain embodiments, the probe 60 may include a single inlet designed to direct the formation fluid 52 into a flowline within the downhole tool 12. Further, in other embodiments, the probe 60 may include multiple inlets that may, for example, be used for focused sampling. In these embodiments, the probe 60 may be connected to a sampling flow line, as well as to guard flow lines. The probe 60 may be movable between extended and retracted positions for selectively engaging the wellbore wall 58 of the wellbore 14 and acquiring fluid samples from the geological formation 20. One or more setting pistons 64 may be provided to assist in positioning the fluid communication device against the wellbore wall 58.

The sensors within the sampling system 42 may collect and transmit data 70 associated with the fluid properties and the composition of the formation fluid 52 to a control and data acquisition system 72 at surface 74, where the data 70 may be stored and processed in a data processing system 76 of the control and data acquisition system 72.

The data processing system 76 may include a processor 78, memory 80, storage 82, and/or display 84. The memory 80 may include one or more tangible, non-transitory, machine readable media collectively storing one or more sets of instructions for operating the downhole acquisition tool 16 and estimating an amount of water-based mud filtrate 54 (e.g., drilling mud 32) in the formation fluid 52. The memory 80 may store mixing rules and algorithms associated with the native formation fluid 50 (e.g., uncontaminated formation fluid), the drilling mud 32, and combinations thereof to facilitate estimating an amount of the drilling mud 32 in the formation fluid 52. The data processing system 76 may use the fluid property and composition information of the data 70 to estimate an amount of the water-based mud filtrate in the formation fluid 52, as discussed in further detail below with reference to FIG. 3. In certain embodiments, the data processing system 76 may apply filters to remove noise from the data 70. In addition, the data processing system 76 may select fluid property data 70 that has enough contrast between the native formation fluid 50 and the pure water-based mud 32. For example, certain fluid and compositional parameters between the native formation fluid 50 and the pure water-based mud filtrate 54 (e.g., the drilling mud 32) may be similar, such that it may be difficult to differentiate between the two fluids. However, by selecting parameters that clearly differentiate the native formation fluid 50 and the pure water-based mud filtrate 54, the quantification accuracy of the water-based mud filtrate 54 contamination may be increased. By way of example, the data processing system 76 may select fluid property parameters such as optical density (OD), density, resistivity, and conductivity to determine the amount of water-based mud filtrate 54 contamination in the native formation fluid 50.

To process the data 70, the processor 78 may execute instructions stored in the memory 80 and/or storage 82. For example, the instructions may cause the processor to quantify the amount of water-based mud filtrate 54 contamination in the formation fluid 52, and estimate fluid and compositional parameters of the native formation fluid 50 and the pure water-based mud filtrate 54, as discussed in further detail below. As such, the memory 80 and/or storage 82 of the data processing system 76 may be any suitable article of manufacture that can store the instructions. By way of example, the memory 80 and/or the storage 82 may be ROM memory, random-access memory (RAM), flash memory, an optical storage medium, or a hard disk drive. The display 84 may be any suitable electronic display that can display information (e.g., logs, tables, cross-plots, etc.) relating to properties of the well as measured by the downhole acquisition tool 16. It should be appreciated that, although the data processing system 76 is shown by way of example as being located at the surface 74, the data processing system 76 may be located in the downhole acquisition tool 16. In such embodiments, some of the data 70 may be processed and stored downhole (e.g., within the wellbore 14), while some of the data 70 may be sent to the surface 74 (e.g., in real time).

FIG. 2 depicts an example of a wireline downhole tool 100 that may employ the systems and techniques described herein to monitor water-based mud contamination of the formation fluid 52. The downhole tool 100 is suspended in the wellbore 14 from the lower end of a multi-conductor cable 104 that is spooled on a winch at the surface 74. Similar to the downhole tool 12, the wireline downhole tool 100 may be conveyed on wired drill pipe, a combination of wired drill pipe and wireline, or other suitable types of conveyance. The cable 104 is communicatively coupled to an electronics and processing system 106. The downhole tool 100 includes an elongated body 108 that houses modules 110, 112, 114, 122, and 124, that provide various functionalities including fluid sampling, fluid testing, operational control, and communication, among others. For example, the modules 110 and 112 may provide additional functionality such as fluid analysis, resistivity measurements, operational control, communications, coring, and/or imaging, among others.

As shown in FIG. 2, the module 114 is a fluid communication module 114 that has a selectively extendable probe 116 and backup pistons 118 that are arranged on opposite sides of the elongated body 108. The extendable probe 116 is configured to selectively seal off or isolate selected portions of the wall 58 of the wellbore 14 to fluidly couple to the adjacent geological formation 20 and/or to draw fluid samples from the geological formation 20. The probe 116 may include a single inlet or multiple inlets designed for guarded or focused sampling. The native formation fluid 50 may be expelled to the wellbore through a port in the body 108 or the formation fluid 52, including the native formation fluid 50, may be sent to one or more fluid sampling modules 122 and 124. The fluid sampling modules 122 and 124 may include sample chambers that store the formation fluid 52. In the illustrated example, the electronics and processing system 106 and/or a downhole control system are configured to control the extendable probe assembly 116 and/or the drawing of a fluid sample from the geological formation 20 to enable analysis of the formation fluid 52 for oil based mud filtrate contamination, as discussed above.

Figure 3:
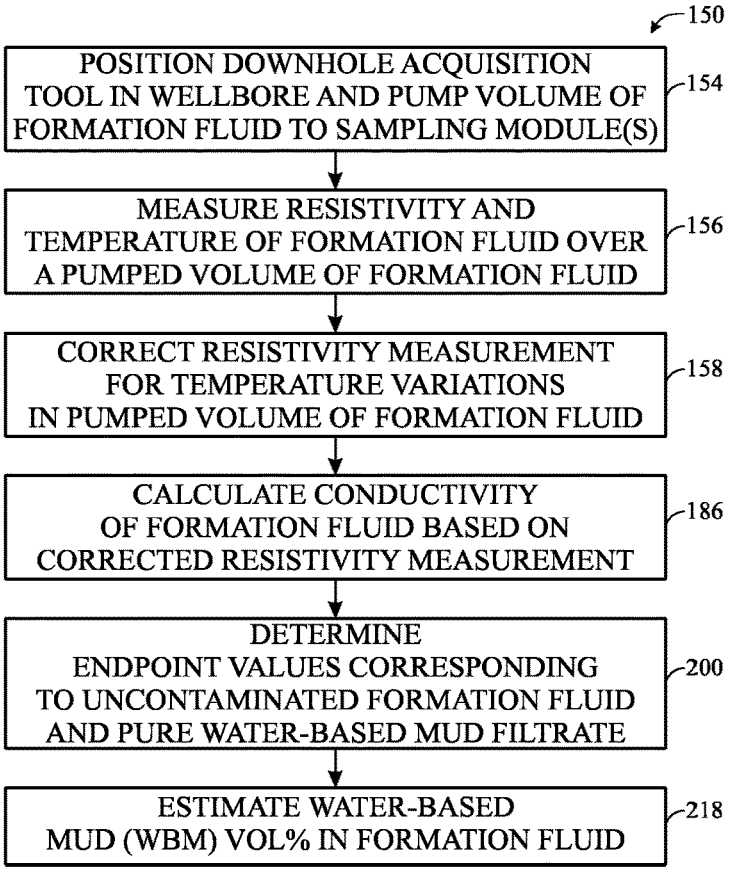
FIG. 3 is a flowchart of a method for using the downhole acquisition tool system of FIGS. 1 and 2 to estimate water-based mud contamination in a native reservoir fluid, in accordance with an embodiment.

A method for monitoring the water-based mud contamination in the formation fluid 52 is illustrated in flowchart 150 of FIG. 3. For example, in the illustrated flowchart 150, the downhole acquisition tool 16 is positioned at a desired depth within the wellbore 14 and a volume of the formation fluid 52 is directed to the sampling modules (e.g., modules 48, 122, 124) for analysis (block 154). For example, the downhole acquisition tool 16 is lowered into the wellbore 14, as discussed above, such that the probe 60, 116 is within a fluid sampling region of interest. The probe 60, 116 faces toward the geological formation 20 to enable a flow of the formation fluid 52 through the flowline toward the sampling modules 48, 122, 124.

While in the downhole acquisition tool 16, the multiple sensors detect and transmit fluid and compositional parameters (e.g., the data 70) of the formation fluid 52 such as, but not limited to, resistivity, density (p), composition, optical density (OD), shrinkage factor (b), pH, and any other suitable parameter of the formation fluid 52 to the data processing system 76. In one embodiment, the downhole acquisition tool 16 measures the density, resistivity, and temperature of the formation fluid 52 over a pumped volume of the formation fluid 52 (block 156). In certain embodiments, the downhole acquisition tool 16 also measures conductivity of the formation fluid 52. As discussed above, the resistivity of the formation fluid 52 may be used to determine an amount of water-based mud filtrate contamination in the formation fluid 52. For example, the resistivity of the formation fluid 52 may be used to calculate a conductivity of the formation fluid 52, which may be used to quantify the water-based mud filtrate contamination in the formation fluid 52.

As discussed above, downhole monitoring for water-based mud filtrate contamination does not account for variations in the temperature of the formation fluid 52, which may result in inaccurate quantification of the water-based mud filtrate 54 in the formation fluid 52. Downhole water-based mud filtrate contamination monitoring assumes that formation fluid, such as the formation fluid 52, has a constant temperature. However, the temperature of the formation fluid 52 may vary over time, volume of formation fluid 52 pumped into the sampling modules 48, 122, 124, and/or depth at which the formation fluid 52 is sampled. Therefore, without the disclosed embodiments, quantification of the water-based mud filtrate 54 in the formation fluid 52 may be inaccurate.

Additionally, it may take time for the downhole acquisition tool 16 to equilibrate with wellbore and/or formation fluid temperatures, thereby resulting in temperature variations for the sampled fluid. For example, during sampling at a first station in the wellbore 14, a temperature of the downhole acquisition tool 16 gradually increases from a surface temperature to a temperature of the formation fluid 52 as the volume of formation fluid 52 pumped into the downhole acquisition tool 16 increases. As such, the temperature of the formation fluid 52 may continue to change until the temperature of the downhole acquisition tool 16 is at wellbore and/or formation fluid temperatures. Consequently, the resistivity and/or the conductivity of the formation fluid 52 may vary at the first station, resulting in inaccurate quantification of water-based mud filtrate 54 in the formation fluid 52. However, by correcting the resistivity and/or conductivity of the formation fluid 52 for variations in fluid temperatures, the accuracy of water-based mud filtrate contamination may be improved for downhole fluid analysis.

Models may be used to determine the variation of conductivity of a solution caused by temperature fluctuations. These models generally use the molality of dissolved salts in a solution to determine the conductivity. In downhole fluid analysis, the molality of the formation fluid 52 is generally unknown. Therefore, models that use the molality of the solution to determine conductivity at different temperatures may be difficult to implement for downhole fluid analysis because the molality of the formation fluid 52 may be unknown. However, in certain embodiments, the resistivity of the formation fluid 52 at a desired temperature may be used in an iterative scheme that assumes the sole presence of aqueous sodium chloride (NaCl), which is the dominant salt in formation water, to estimate the molality of aqueous NaCl in the formation fluid 52. The estimated molality of aqueous NaCl may be used to calculate a temperature dependence of the resistivity and conductivity (calculated from the resistivity) from the model, which can then be used to determine a temperature correction for the resistivity and/or conductivity. By way of non-limiting example, the Mixed Solvent Electrolyte (MSE) model provided by OLI Systems, Inc. may be used to determine resistivity and/or conductivity variations caused by temperature fluctuations of a solution.

In other embodiments, a temperature-dependent resistivity equation may be used to determine the resistivity of the formation fluid 52 at different temperatures. The temperature-dependent resistivity equation is expressed as follows:

$$R_1(T_1+21.5)=R_2(T_2+21.5) \quad \text{(EQ. 1)}$$

where $R_1$ and $T_1$ are the initial resistivity in ohm·meter (Ω·m) and temperature ° C. of the formation fluid 52 and $R_2$ is the resistivity at a different temperature $T_2$ of the formation fluid 52. As described in further detail below, the data processing system 76 may correct the resistivity of the formation fluid 52 for a given temperature based on EQ. 1.

Figure 4:
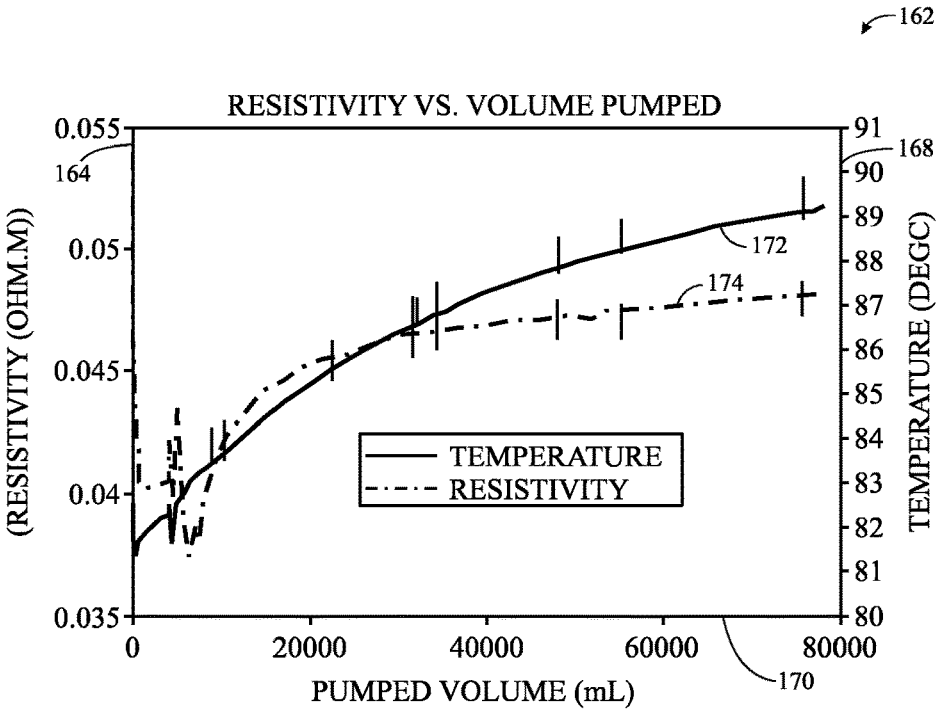
FIG. 4 is a plot of a relationship between a measured resistivity, a temperature, and a pumped volume of formation fluid, in accordance with an embodiment.

FIG. 4 is a plot 162 showing resistivity 164 (Ohm·meters (Ω·m)) and temperature 168 (degrees Celsius (° C.)) as a function of pumped volume 170 (milliliter (mL)) for the formation fluid 52 (e.g., formation water) at a particular depth and station in the formation 12. As shown in FIG. 4, the temperature data points 172 of the formation fluid 52 gradually increase over the pumped volume 170 of the formation fluid 52. For example, in the illustrated embodiment, the temperature data points 172 increase greater than approximately 8° C. over the pumped volume 170. Consequently, resistivity data points 174 of the formation fluid 52 also increase over the pumped volume 170. Therefore, in addition to an amount of water-based mud filtrate contamination, the temperature of the formation fluid 52 also affects the measured resistivity. Accordingly, water-based mud filtrate contamination monitoring techniques assuming that the temperature of the formation fluid 52 (e.g., the formation water) is constant such that changes in the resistivity of the formation fluid 52 is solely based on an amount of water-based mud filtrate contamination may result in inaccurate quantification of the water-based mud filtrate contamination in the formation fluid 52.

Figure 5:
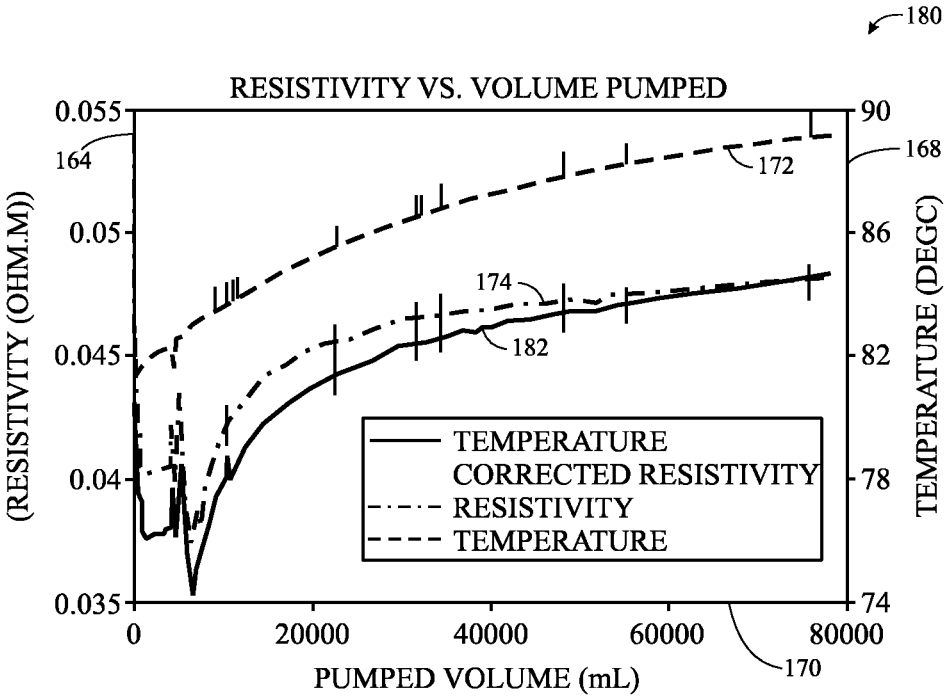
FIG. 5 is a plot of a relationship between the measured resistivity of FIG. 4, a temperature-corrected resistivity, the temperature, and the pumped volume of the formation fluid, in accordance with an embodiment.

To improve the accuracy of downhole fluid analysis for water-based mud filtrate contamination, temperature variations of the formation fluid 52 may need to be considered. This may be done by using EQ. 1 to correct the resistivity of the formation fluid 52 for the temperature variations of the formation fluid 52 over the pumped volume 170. For example, FIG. 5 illustrates a plot 180 of the resistivity 164 and the temperature 168 as a function of the pumped volume 170 of the formation fluid 52. The plot 180 compares the resistivity data points 174 and temperature corrected resistivity data points 182. To calculate the corrected resistivity data points 182, a reference temperature is selected from the temperature data points 172. In the illustrated embodiment, the reference temperature used to generate the corrected resistivity data points 182 was selected from the temperature data points 172 near an end of the pumped volume 170 (e.g., near approximately 80,000 mL). For example, the initial/reference temperature $T_1$ selected was 89° C. However, any other temperature data point 172 may be selected to generate the corrected resistivity data points 172 (e.g., $R_2$). In certain embodiments, $T_1$ is selected from the temperature data points 172 near a beginning of the pumped volume 170 (e.g., near approximately 0 mL).

As shown in FIG. 5, the corrected resistivity data points 182 (e.g., $R_2$) are less than the resistivity data points 174 for pumped volumes 170 that are less than 60,000 mL, and are approximately equal to the resistivity data points 174 for pumped volumes 170 that are greater than 60,000 mL. This may be due, in part, to selecting $T_1$ from the temperature data point 172 that is toward the end of the pumped volume 170. If, for example, the temperature data point 172 had been selected from the beginning of the pumped volume 170 (e.g., the temperature data point 172 at approximately 20,000 mL), the difference between the data points 174, 182 would increase, rather than decrease, with increasing pumped volume 170.

Returning to FIG. 3, once the resistivity of the formation fluid 52 is corrected for the temperature variation over the pumped volume, the method further includes calculating the conductivity of the formation fluid 52 based on the corrected resistivity data points 182 (block 186). The conductivity for the formation fluid 52 may be calculated using the following relationship:

$$\text{Conductivity}(C)=1/R \quad \text{(EQ. 2)}$$

By using the corrected resistivity data points 182 to calculate the conductivity of the formation fluid 52, the quantification accuracy of the water-based mud filtrate 54 in the formation fluid 52 may be improved. As such, operators may determine the economic value of the hydrocarbon reservoir with more accuracy and confidence. In certain embodiments, the conductivity for the formation fluid 52 may be corrected for temperature variations using other techniques that do not include using the corrected resistivity. For example, the conductivity for the formation fluid 52 may be measured with conductivity sensors downhole. The data processing system 76 may use the measured conductivity to calculate the resistivity of the formation fluid 52 using, for example, EQ. 2, correct the resistivity using EQ. 1, and convert the corrected resistivity to a corrected conductivity using EQ. 2. In other embodiments, the data processing system 76 may apply a temperature correction factor/coefficient to correct the conductivity for temperature variations downhole.

Figure 6:
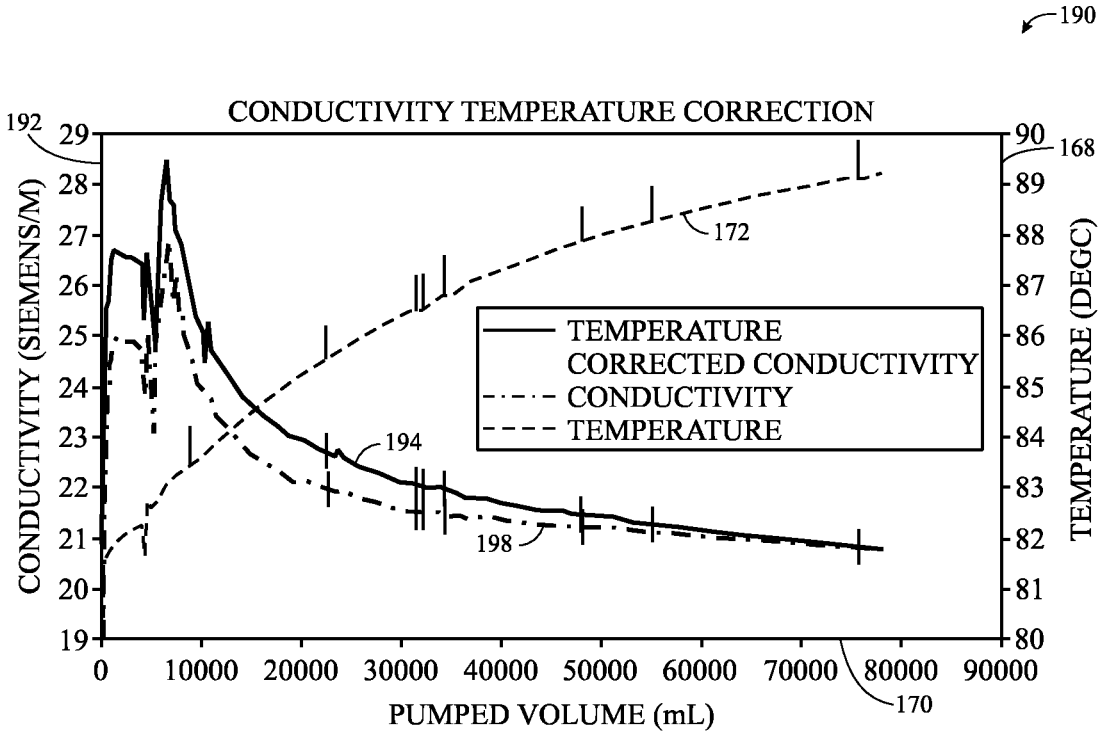
FIG. 6 is a plot of a relationship between a non-corrected conductivity calculated from the measured resistivity of FIG. 4, a temperature-corrected conductivity calculated from the temperature-corrected resistivity of FIG. 5, and the pumped volume of formation fluid, in accordance with an embodiment.

FIG. 6 is a plot 190 illustrating conductivity 192 (Siemens/meter (S/m)) as a function of the pumped volume 170 of the formation fluid 52. As shown in the illustrated embodiment, the conductivity of the formation fluid 52 is higher for corrected conductivity data points 194 compared to non-corrected conductivity data points 198 for pumped volumes less than 60,000 mL. The data points 194, 198 were calculated using resistivity data points 1174, 182, respectively. Therefore, the corrected conductivity data points 194 change the water-based mud filtrate conductivity relative to the formation water conductivity. Consequently, an amount of water-based mud filtrate contamination calculated from the conductivity of the formation fluid 52 also changes. That is, the amount of water-based mud filtrate contamination calculated using the non-corrected conductivity data points 198 is different from the amount calculated using the corrected conductivity data points 194. Because the corrected conductivity data points 194 have been corrected for the temperature variations in the formation fluid 52 over the pumped volume 170 (e.g., over time), the amount of water-based mud filtrate contamination calculated using the corrected conductivity data points 194 may be more accurate compared to the amount of water-based mud filtrate contamination calculated using the non-corrected conductivity data points 198.

One advantage of correcting the conductivity of the formation fluid 52 for temperature variations over the pumped volume 170 is that the corrected conductivity changes linearly with contamination. Therefore, a linear relationship between the corrected conductivity and the other fluid properties (e.g., optical density (OD), density, among others) of the formation fluid 52 may be established. In addition, in certain embodiments, a linear relationship between the corrected resistivity and the other fluid properties of the formation fluid 52 may also be established. Based on the linear relationship between the fluid properties of the formation fluid 52, an amount of the water-based mud filtrate 54 contamination in the formation fluid 52 may be determined using, for example, mixing rules.

However, prior to estimating the water-based mud filtrate 54 contamination, fluid properties for the native formation fluid 50 and the pure water-based mud filtrate 54 (e.g., endpoints) may need to be determined. Accordingly, returning to FIG. 3, the method 150 includes determining endpoint values corresponding to the native formation fluid 50 and the pure water-based mud filtrate 54 (block 200). For example, in certain embodiments, the conductivity of pure water-based mud filtrate 54 may be measured on the surface 74 from, for example, a pressed mud, at ambient temperature and pressure. The conductivity of the pure water-based mud filtrate 54 at the surface 74 may be corrected for downhole temperature, for example, using EQs. 1 and 2. In certain embodiments, the conductivity of the pure water-based mud filtrate 54 at the surface 74 may also be corrected for downhole pressure.

In certain embodiments, a large amount of water-based mud 32 may penetrate the geological formation 20. As such, the initial flow of the formation fluid 52 flowing through the flow line may be essentially pure water-based mud filtrate 54. Therefore, the fluid property parameters (e.g., OD, density, resistivity, conductivity, and other fluid properties) for the pure water-based mud filtrate 54 in the initial flow of the formation fluid 52 into the flow line may be obtained at the start of drilling fluid analysis in the sampling modules 48, 122, 124. Consequently, once the fluid property and compositional parameters of the pure oil-based mud filtrate 54 are known, the mixing rules in EQ. 6-8 discussed below may be used to estimate the oil-based mud filtrate 54 contamination in the formation fluid 52.

In other embodiments, a power-law decay model for the filtrate contamination may be used to obtain the endpoint parameters for the native formation fluid 50. For example, the changing fluid properties over time and/or pumpout volume (e.g., volume of the mixed invaded/contaminated fluid and native formation fluid 50 pumped out of the geological formation 20 and into the wellbore 14 and the downhole acquisition tool 16) may be used to obtain native formation fluid 50 properties during cleanup. Power functions (e.g., exponential, asymptote, or other functions) may be used to fit the data (e.g., real time data) from the downhole fluid analysis to determine the fluid properties of the native formation fluid 50. Derivation of the power-law decay model is described in U.S. Patent Application Ser. No. 61/985,376 assigned to Schlumberger Technology Corporation and is hereby incorporated by reference in its entirety. By way of example, a power-law model for density and temperature corrected resistivity that may be used for obtaining native formation fluid 50 and pure water-based mud filtrate 54 fluid properties is expressed as:

$$\rho=\rho_{wf}-\beta V^{-\gamma} \quad \text{(EQ. 3)}$$

$$1/R=(1/R_{wf})-\beta V^{-\gamma} \quad \text{(EQ. 4)}$$

where

Figure 7:
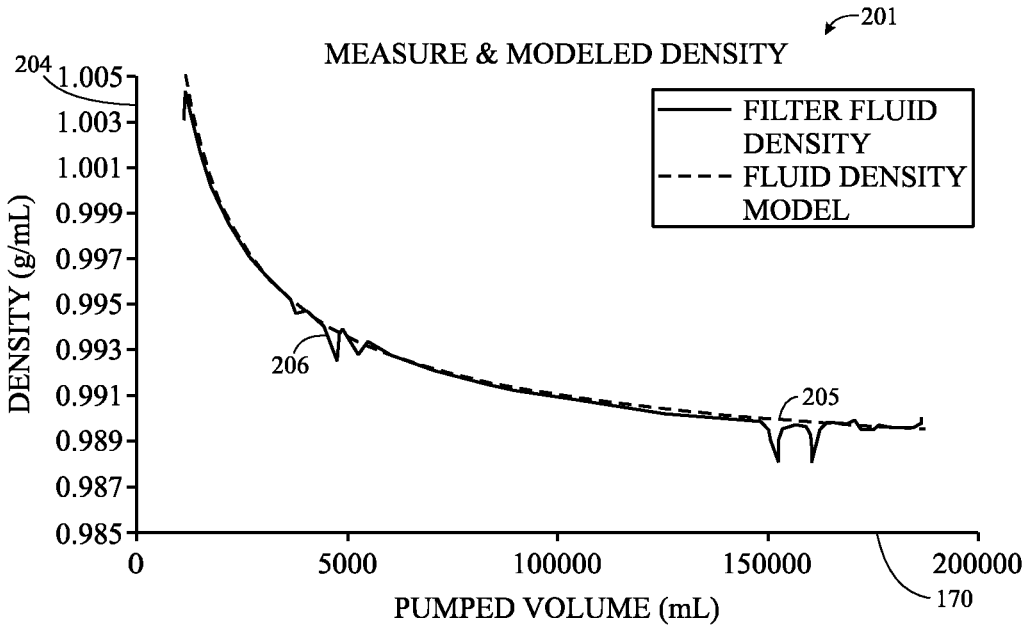
FIG. 7 is a plot of a relationship between power law modeled density data and measured density data, in accordance with an embodiment.
Figure 8:
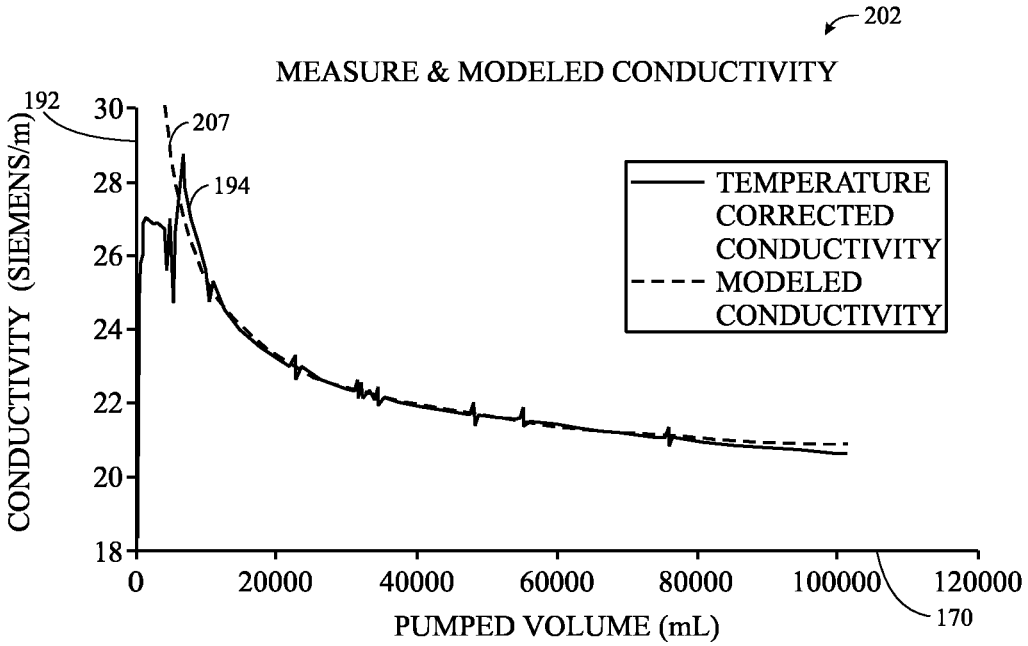
FIG. 8 is a plot of a relationship between power law modeled conductivity data and corrected conductivity data, in accordance with an embodiment.

V is the volume of fluid pumped from the geological formation to the drilling fluid analysis $\gamma$ is a parameter of the probe sampling or an adjustment parameter $\beta$ is a fitting parameter $\rho_{wf}$ is a fitting parameter and represents the density of the formation water $R_{wf}$ is a fitting parameter and represents the resistivity of the formation water In certain embodiments, the downhole acquisition tool 16 may be an unfocused probe sampling tool (e.g., a 3-D radial unfocused sampling tool or any other suitable unfocused probe sampling tool). Therefore, γ may be between approximately 5/12 and approximately 2/3 depending of the type of unfocused probe sampling tool and the flow regime. By way of example, γ may be approximately 5/12 for an intermediate flow regime and approximately 2/3 for a development flow region. The adjustable parameter, β, may be the difference in the fluid properties between the water-based mud filtrate 54 and the native formation fluid 50. The density (ρ) and conductivity (calculated from the resistivity according to EQ. 2) measured from the clean up may be fitted to the power law models. For example, FIGS. 7 and 8 illustrate plots 201 and 202 for density 204 and conductivity 192, respectively, over the pumped volume 170. As shown in FIG. 7, modeled density data points 205 generated based on the power law model for density is fitted to measured density data points 206. Similarly, in FIG. 8, modeled conductivity data points 207 generated based on the power law model for conductivity is fitted to the corrected conductivity data points 194. To determine the density (ρ) and conductivity (e.g., from the resistivity) of the native formation fluid 50, the volume V may be extrapolated to infinity. Alternatively, pressure gradient of the formation fluid 52 may be used to obtain $\rho_{wf}$.

In other embodiments, Archie's equation (EQ. 5) can be used to determine the native fluid resistivity $R_w$. Archie's equation may be expressed as:

$$S_w=[(a/\Phi^m)(R_w/R_t)]^{1/n} \quad \text{(EQ. 5)}$$

where $S_w$ is water saturation

Φ is porosity of the formation $R_w$ is the resistivity of the native formation fluid $R_t$ is the observed bulk resistivity a is a constant, which is generally 1 m is a cementation factor n is a saturation exponent, which is generally 2.

A table of an example case, along with computed data for the resistivity and conductivity for the pure water-based mud filtrate and the native formation fluid (e.g., endpoints) from FIGS. 4-6 is shown below. The computed data was generated using the deep filtrate invasion and power law model fitting and extrapolation techniques discussed above. Using the data points 174, 182 obtained from the plot 180 of FIG. 5, the resistivity from early station data (e.g., at a pumped volume of less than approximately 20,000 mL) of the formation fluid 52 was used to calculate the conductivity of the pure water-based mud filtrate 54. A reference temperature of 89° C. was used as the initial temperature (e.g., $T_1$ in EQ. 1) to correct the resistivity and conductivity data listed in Table 1.

TABLE 1

Endpoint Resistivity and Conductivity

| | | UNCORRECTED | | CORRECTED | |
|---|---|---|---|---|---|
| | Pumped Volume (mL) | Resistivity (Ω · m) | Conductivity (S/m) | Resistivity (Ω · m) | Conductivity (S/m) |
| Water-based mud filtrate | 7000 | 0.037 | 27.027 | 0.0348 | 28.7245 |
| Native Formation Fluid | — | 0.0504 | 19.8568 | 0.0516 | 19.3733 |

In other embodiments, the conductivity of the pure water-based mud filtrate 54 and the native formation fluid 50 may be determined using cross plots. For example, due to the linearity between the corrected conductivity and other fluid property parameters of the formation fluid 52, cross plots of, for example, conductivity vs density may be used to determine the endpoints. Using the temperature-corrected conductivity of the formation fluid 52 in combination with at least one other fluid property (e.g., density) to estimate an amount of the water-based mud filtrate 54 contamination may provide a more robust and reliable quantification of the water-based mud filtrate 54 for water-based mud filtrate contamination monitoring applications. The cross plots are created by plotting changes of two fluid properties (e.g., conductivity and density) driven by changes in an amount of water-based mud filtrate contamination. Additionally, the cross plots may allow assessment of the native formation fluid 50 and the pure water-based mud filtrate 54 properties (e.g., uncontaminated formation fluid) by extrapolating the corrected conductivity and density parameters. For example, when the density of the water-based mud filtrate 54 is known and the conductivity is unknown, the filtrate conductivity may be determined by extrapolating the cross plot to the known density value and reading the conductivity from the plot. This may also be done in embodiments where the filtrate conductivity is known and the filtrate density is unknown.

Similarly, when the conductivity of the native formation fluid 52 is known (e.g., from EQ. 5), the density of the native formation fluid 52 may be determined by extrapolating the cross plot to the known conductivity parameter and reading the density at that point from the cross plot. In certain embodiments, the conductivity and the density of the native formation fluid 52 may be known (e.g., from power law model (EQs. 3 and 4) fitting and extrapolating). The known conductivity and density of the native formation fluid 52 may be plotted on a cross plot. Since the extrapolated cross plot contains the intrinsic relationship between density and conductivity, the endpoint data for the native formation fluid 52 should fall on the extrapolated plot. Comparing the fluid properties of the native formation fluid 52 obtained from the power law model (EQs. 3 and 4) to the plotted position on the cross plot may facilitate quality control for the endpoint data.

As discussed above, correcting the conductivity for temperature variations of the formation fluid 52 may establish a linear relationship between the conductivity and at least one other fluid property parameter of the formation fluid 52. The fluid properties ($OD_t$, density (ρ), resistivity, and conductivity) change with a volume of fluid (e.g., the formation fluid 52) pumped into the flow line of the downhole acquisition tool 16 over time. That is, a concentration of water-based mud filtrate 54 in the formation fluid 52 may decrease over time as the native formation fluid 50 continues to flow from the geological formation 20 into the wellbore 14 and through the flow line, thereby changing the overall composition and fluid properties of the formation fluid 52 (e.g., from water-based mud contaminated formation fluid to the native formation fluid 50) measured in the sampling modules 48, 122, 124. Moreover, density (ρ) and corrected conductivity are mutually linearly related because the properties of the native formation fluid 50 and the pure water-based mud filtrate 54 are unvaried (e.g., constant). As such, in certain embodiments, the data processing system 76 may establish cross plots among the fluid properties to verify the linear relationship between the corrected conductivity and the $OD_i$ and/or density (ρ) parameters of the formation fluid 52. The temperature corrected resistivity may also have a linear relationship with the density, or other fluid properties. Accordingly, in certain embodiments, the data processing system 76 may establish cross-plots to verify the linear relationship between the $OD_i$ and/or density (ρ) parameters of the formation fluid 52. An example cross-plot demonstrating the linear relationship between the corrected conductivity and the density for a water-based mud contaminated fluid is shown in FIG. 9 and described in further detail below.

Figure 9:
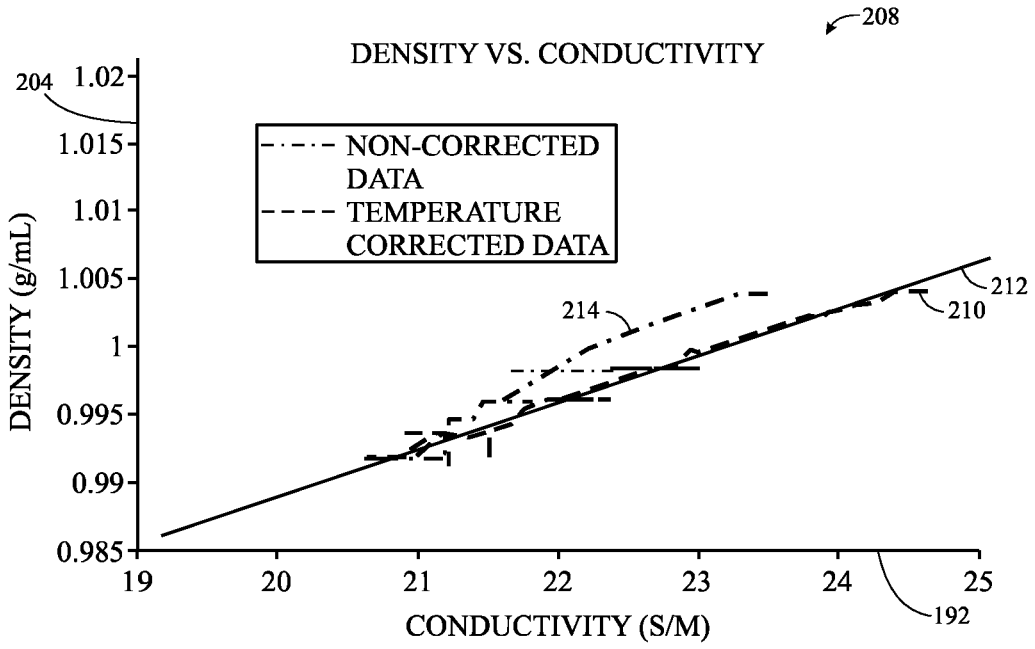
FIG. 9 is a plot of a relationship between the non-corrected and temperature-corrected conductivity of FIG. 6 and a density of the formation fluid, in accordance with an embodiment.

FIG. 9 shows a cross-plot 208 of the density 204 (grams/mL (g/mL)) as a function of the conductivity 192 for the example case of the water-based mud contaminated fluid shown in FIGS. 4-6. The cross-plot 208 shows a linear relationship between the density and the corrected conductivity. For example, the cross-plot 208 includes temperature-corrected data points 210 verifying the linear relationship between the density and the corrected conductivity, as shown by line 212. In contrast, a linear relationship between the density 204 and the conductivity 192 for non-corrected data points 214 does not appear to be established. The data points 210, 214 may be noisy towards the beginning of sampling. This may be due, in part, to the presence of a water-based mud filter cake in the flow line, which may have generated noise within the resistivity measurement of the formation fluid 52.

Based on the data provided in the cross-plot 208, the linear relationship between the corrected conductivity and the fluid property parameters (e.g., density) is established. Therefore, the data processing system 76 may estimate the density or conductivity for the native formation fluid 50 and the pure water-based mud (e.g., the drilling mud 32/water-based mud filtrate 54) based on the known fluid parameter for the native formation fluid 52 and the pure water-based, as discussed above. For example, in certain embodiments, the data processing system 76 may extrapolate the values in the cross-plot 208 to determine the density (ρ) and conductivity of the native formation fluid 50 and the pure water-based mud filtrate 54. Due to the linearity of the fluid property and composition parameters, robust and reliable endpoints (e.g., fluid and composition properties of the native formation fluid 50 and the pure water-based mud filtrate 54) may be obtained.

Similarly, if the endpoints are known (e.g., determined via other techniques discussed above), the conductivity values for the formation fluid 52 may be determined from the cross-plot 208. For example, when the density of the native formation fluid 50 and the pure water-based mud filtrate 54 are known, the conductivity of the native formation fluid 50 and the pure water based mud filtrate 54 may be determined due to the linearity between the density and corrected conductivity. The cross-plot 208 may also be used to validate consistency between the measured density and conductivity when the density and conductivity endpoints for the native formation fluid 50 and the pure-water based mud filtrate 54 are known. In certain embodiments, the density and the corrected conductivity of the water-based mud filtrate contaminated fluid may be non-linear. In these particular embodiments, the density of the fluid may be corrected to for temperature variations or a different reference temperature may be selected to correct the conductivity data.

Returning to FIG. 3, once the endpoints for the pure-water based mud filtrate 54 and the native formation fluid 50 are known, the method 150 includes estimating an amount of the water-based mud filtrate 54 in the formation fluid 52 (block 218). The amount of water-based mud filtrate contamination in the formation fluid 52 may be determined by using the known fluid properties (e.g., the endpoints) for the pure water-based mud filtrate 54 and the native formation fluid 50 (e.g., uncontaminated formation fluid). For example, as discussed in further detail below, mixing rules for selected fluid properties (e.g., the conductivity and density) of the native formation fluid 50, formation fluid 52, and the pure water-based mud filtrate 54 may be used to determine the water-based mud filtrate contamination.

For the purpose of the following discussions, it is assumed that a water-based mud contaminated formation fluid (e.g., formation fluid 52) is in a single-phase at downhole conditions due to the miscibility of the water-based mud 32 and the formation water present in the native formation fluid 50. Accordingly, the following single phase mixing rules are defined for optical density (OD), EQ. 6; density (ρ), EQ. 7; and conductivity (C), EQ. 8.

$$OD_i = \nu_{wbm} OD_{wbmi} + (1-\nu_{wbm}) OD_{0i} \quad \text{(EQ. 6)}$$

$$\rho = \nu_{wbm} \rho_{wbm} + (1-\nu_{wbm}) \rho_0 \quad \text{(EQ. 7)}$$

$$C_{mixture} = \nu_{wbm} C_{wbm} + (1-\nu_{wbm}) C_0 \quad \text{(EQ. 8)}$$

where $\nu_{wbm}$ is the water-based mud filtrate 54 contamination level in volume fraction and $C_{mixture}$ is the corrected conductivity of the formation fluid 52 based on live fluid. The subscripts 0, wbm, and i represent the uncontaminated formation fluid (e.g., the native formation fluid 50), pure water-based mud filtrate 54, and optical channel i, respectively.

Figure 10:
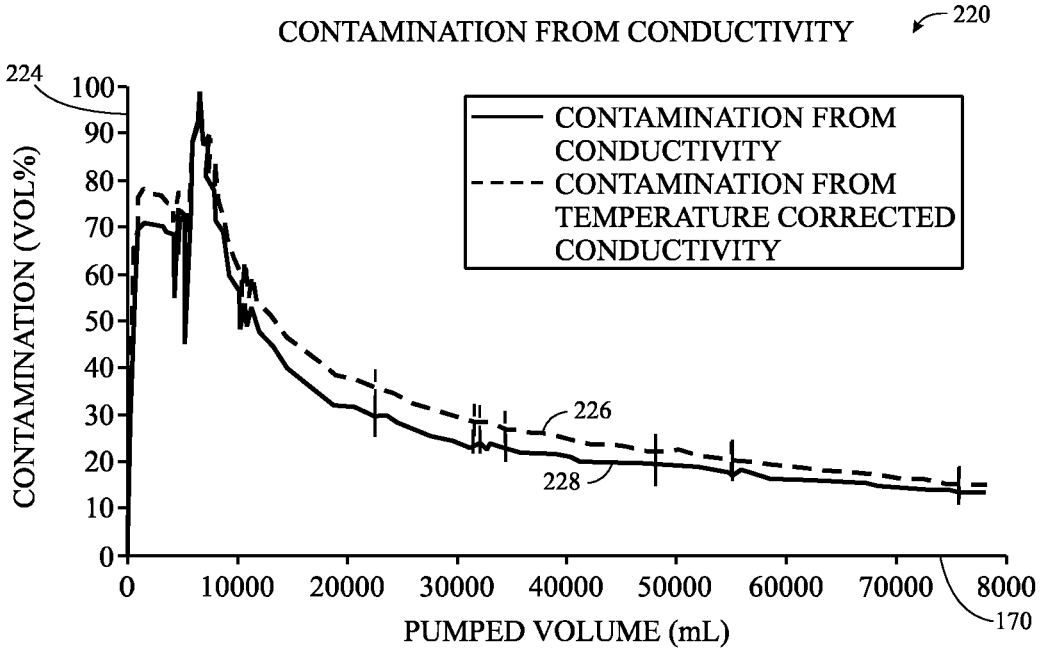
FIG. 10 is a plot of a relationship between water-based mud filtrate contamination calculated from the non-corrected and temperature-corrected conductivity of FIG. 6 and the pumped volume of the formation fluid, in accordance with an embodiment.

FIG. 10 illustrates a plot 220 for water-based mud filtrate contamination 224 (% volume) as a function of the pumped volume 170 generated using the mixing rule for conductivity expressed in EQ. 8. For example, EQ. 8 may be rearranged as shown below in EQ. 9 to determine a volume of the water-based mud filtrate 54 in the formation fluid 52 over the pumped volume 170.

$$\nu_{wbm} = (C_0 - C_{mixture})/(C_0 - C_{wbm}) \quad \text{(EQ. 9)}$$

As shown in FIG. 10, the volume of the water-based mud filtrate 54 decreases over time (e.g., as the pumped volume 170 increases) for both corrected contamination data points 226 (e.g., calculated from corrected conductivity data points 194) and uncorrected contamination data points 228 (e.g., calculated from non-corrected conductivity data points 198). However, the amount of water-based mud filtrate contamination calculated based on the corrected conductivity data points 194 is more than an amount of water-based mud filtrate contamination calculated based on the non-corrected conductivity data points 198 in particular, for pumped volumes less than 60,000 mL. This is due, in part, to selecting the reference temperature (e.g., $T_1$) of the formation fluid 52 at the end of the sampling (e.g., near a pumped volume of approximately 80,000 mL). In certain embodiments, a difference in the amount of the water-based mud filtrate in the formation fluid 52 between the corrected and non-corrected data points 226, 228 may be up to approximately 10%. Therefore, by correcting the conductivity of the formation fluid 52 for temperature variations, the amount of water-based mud filtrate 54 may be determined with greater accuracy compared to using conductivity values that are not temperature corrected. In certain embodiments, the amount of water-based mud filtrate 54 may be determined using the corrected resistivity rather than the conductivity.

As discussed above, and shown in the data presented herein, the disclosed techniques for correcting the resistivity measurement for temperature variations results in a more accurate conductivity parameter for the formation fluid 52 compared to techniques that do not correct resistivity measurements. By correcting the resistivity measurement, and consequently the conductivity, the accuracy of the water-based mud filtrate contamination in the formation fluid 52 may be improved. Additionally, unlike conductivity data that is not corrected for temperature variations, the temperature-corrected conductivity data has a linear relationship with fluid property parameters (e.g., density) used for water-based mud filtrate contamination monitoring of formation fluids (e.g., the fluids 32, 50, 52). In addition, the corrected conductivity data may be used to provide reliable and consistent estimation for native formation fluid 50 and pure oil-based mud filtrate 54 for drilling fluid analysis (e.g., in real time).

The specific embodiments described above have been shown by way of example, and it should be understood that these embodiments may be susceptible to various modifications and alternative forms. It should be further understood that the claims are not intended to be limited to the particular forms discloses, but rather to cover modifications, equivalents, and alternatives falling within the spirit of this disclosure.

The invention claimed is:

1. A method comprising:

operating a downhole acquisition tool in a wellbore in a geological formation, wherein the wellbore or the geological formation, or both, contains a fluid that comprises a native reservoir fluid of the geological formation and a contaminant from a water-based mud;

receiving a portion of the fluid into the downhole acquisition tool;

obtaining a measured resistivity, a measured conductivity, or both and downhole temperature variations of the fluid during the receiving of the portion of the fluid using the downhole acquisition tool; and using a processor of the downhole acquisition tool to calculate a temperature-corrected resistivity, a temperature-corrected conductivity, or both based on the downhole temperature variations of the fluid during the receiving of the portion of the fluid and the measured resistivity, the measured conductivity, or both.

2. The method of claim 1, comprising estimating, using the processor, a volume fraction of the contaminant in the portion of the fluid based at least in part on the temperature-corrected resistivity, the temperature-corrected conductivity, or both of the portion of the fluid.

3. The method of claim 1, wherein the temperature-corrected conductivity of the portion of the fluid is determined based on the downhole temperature of the portion of the fluid and the measured resistivity.

4. The method of claim 1, comprising establishing a linear relationship between the temperature-corrected conductivity and at least one fluid property of the fluid.

5. The method of claim 4, wherein the at least one fluid property comprises a density of the portion of the fluid.

6. The method of claim 1, comprising obtaining corresponding temperature-corrected resistivity, temperature-corrected conductivity, or both for a plurality of other portions of the fluid; and using the processor to determine the estimated volume fraction of the contaminant in the native reservoir fluid based at least in part on the temperature-corrected conductivity for the plurality of other portions of the fluid.

7. The method of claim 1, wherein the estimated volume fraction of the contaminant in the native reservoir fluid is determined using a cross-plot of the temperature-corrected conductivity and a plurality of values of a second fluid parameter, wherein the second fluid parameter comprises a density, optical density, or a combination thereof.

8. The method of claim 1, comprising using the processor to estimate a conductivity of the native reservoir fluid and a conductivity of the contaminant at least by relating the corrected resistivity to a power function associated with the measured resistivity of the portion of the fluid.

9. The method of claim 1, wherein the measured resistivity is corrected using the following relationship:

$$R_1(T_1+21.5)=R_2(T_2+21.5)$$

where $R_1$ represents the measured resistivity at a reference temperature;

$T_1$ represents the reference temperature;

$R_2$ represents the corrected resistivity at a temperature $T_2$.

10. The method of claim 1 wherein the volume fraction of the contaminant in the portion of the fluid is determined based on the following relationship:

$$\nu_{wbm}=(C_0-C_{mixture})/(C_0-C_{wbm})$$

where $\nu_{wbm}$ represents the volume fraction function for the contaminant in the portion of the first fluid;

$C_0$ represents a conductivity of the native reservoir fluid;

$C_{mixture}$ represents a temperature-corrected conductivity of the portion of the fluid;

$C_{wbm}$ represents a conductivity of the pure contaminant.

11. The method of claim 1, wherein the contaminant comprises a water-based mud filtrate and the native reservoir fluid comprises native formation water.

12. The method of claim 1, wherein $C_0$ is obtained by fitting and extrapolating a power law function to the temperature-corrected conductivity.

13. A downhole fluid testing system comprising:

a downhole acquisition tool configured to be moved into a wellbore in a geological formation, wherein the wellbore or the geological formation, or both, contains fluid that comprises a native reservoir fluid of the geological formation and a contaminant from a water-based mud, wherein the downhole acquisition tool comprises a sensor disposed in a downhole acquisition tool housing that is configured to analyze portions of the fluid and obtain sets of properties of the portions of the fluid, wherein each set of properties includes a measured resistivity, a measured conductivity, or both and downhole temperature as a function of time showing temperature variations of the fluid during the receiving of the portion of the fluid; and a data processing system configured to estimate a volume fraction of the contaminant in at least one of the portions of the fluid based at least in part on the measured resistivity or the measured conductivity of the at least one portion of the fluid, wherein the data processing system comprises one or more non-transitory, machine-readable media comprising instructions configured to adjust the measured resistivity, the measured conductivity, or both based on the downhole temperature variations of the fluid during the receiving of the portion of the fluid to calculate a temperature-corrected resistivity, a temperature-corrected conductivity, or both.

14. The system of claim 13, wherein the instructions are configured to estimate the volume fraction of the contaminant based on the temperature-corrected resistivity, the temperature-corrected conductivity, or both.

15. The system of claim 13, wherein the instructions are configured to calculate the temperature-corrected conductivity of the portions of the fluid based on the temperature-corrected resistivity before estimating the volume fraction of the contaminant.

16. The system of claim 13, wherein the instructions are configured to estimate the volume fraction of the contaminant in the native reservoir fluid using a cross-plot of the temperature-corrected resistivity, the temperature-corrected conductivity, or both and a plurality of values of a second fluid parameter, wherein the second fluid parameter comprises a density, optical density, or a combination thereof.

17. The system of claim 13, wherein the instructions are configured to estimate a conductivity of the native reservoir fluid and a conductivity of the contaminant at least in part by relating the temperature-corrected resistivity to a power function associated with the resistivity of the portion of the fluid.

18. The system of claim 13, wherein the data processing system is disposed within the downhole acquisition tool housing, or outside the downhole acquisition tool housing at the surface, or both partly within the downhole acquisition tool housing and partly outside the downhole acquisition tool housing at the surface.

19. One or more tangible, non-transitory, machine-readable media comprising instructions to:

receive a fluid parameter of a portion of fluid as analyzed by a downhole acquisition tool in a wellbore in a geological formation, wherein the wellbore or the geological formation, or both, contains the fluid, wherein the fluid comprises a mixture of native reservoir fluid of the geological formation and a contaminant from a water-based mud, and wherein the fluid parameter includes a measured resistivity, a measured conductivity, or both and a downhole temperature variations of the fluid during the receiving of the portion of the fluid; and estimate a volume fraction of the contaminant in the portion of the fluid based at least in part on a temperature-corrected resistivity, a temperature-corrected conductivity, or both of the portion of the fluid, wherein the temperature-corrected resistivity and the temperature-corrected conductivity are calculated based on the measured resistivity, the measured conductivity, or both and the downhole temperature variations of the fluid during the receiving of the portion of the fluid before estimating the volume fraction of the contaminant.

20. The one or more machine-readable media of claim 19, wherein the temperature-corrected conductivity is calculated based on the temperature-corrected resistivity.

* * * * *